United States Patent [19]

Fink

[11] 4,155,555

[45] May 22, 1979

[54] GOLF SWING PRACTICE APPARATUS

[76] Inventor: Lyman R. Fink, 4438 Centerview, San Antonio, Tex. 78228

[21] Appl. No.: 718,751

[22] Filed: Aug. 30, 1976

[51] Int. Cl.[2] ..... A63B 69/36

[52] U.S. Cl. ..... 273/186 R; 273/DIG. 26; 206/315 R

[58] Field of Search ..... 273/186 R, 186 RA, 186 A

[56] References Cited

U.S. PATENT DOCUMENTS

| | | | |
|---|---|---|---|
| 3,194,563 | 7/1965 | MacKniesh | 273/186 A |
| 3,601,408 | 8/1971 | Wright | 273/186 R |

*Primary Examiner*—George J. Marlo

*Attorney, Agent, or Firm*—Arnold, White & Durkee

[57] ABSTRACT

A measuring and display apparatus for discretely presenting various characteristics concerning a practice golf swing. These characteristics include velocity and face angle for a putting stroke and, for a fuller stroke, velocity, face angle (or alternatively, hand position), "sweet spot" miss, and path deviation. Photoelectric sensors in a portable cabinet are used in the full-swing apparatus, thereby avoiding use of sensors embedded in a mat, and hence subject to injury. The cabinet is conveniently supported by legs that are rotatable for use as a handle, thereby making the entire unit quite portable in one, relatively small unit.

10 Claims, 12 Drawing Figures

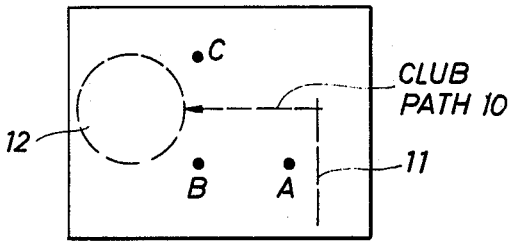
FIG. 1
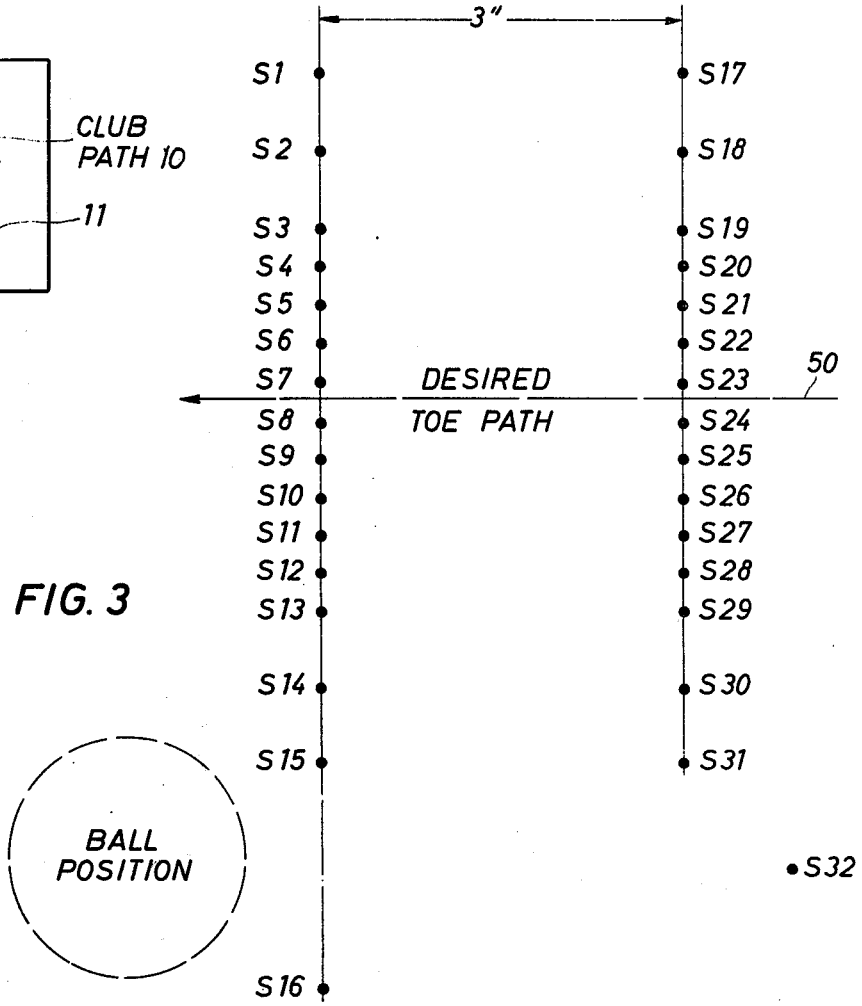
FIG. 3
FIG. 2B
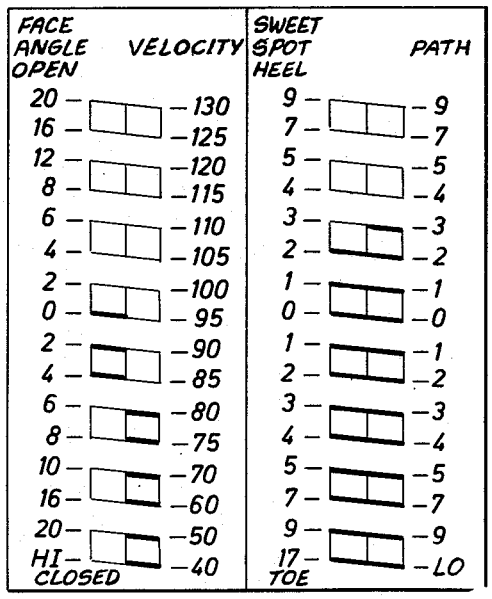
FIG. 2A
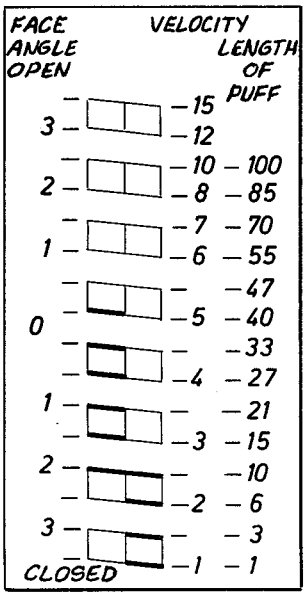

GOLF SWING PRACTICE APPARATUS

BACKGROUND OF THE INVENTION

1. Field of the Invention

This invention pertains to golf practice apparatus and more specifically to substantially all electronic gold swing practice apparatus for measuring and displaying various important component parts or characteristics of a practice golf swing, these displays being in discrete form.

2. Description of the Prior Art

The game of golf is one of the world's most popular participation sports. It is also one of the most difficult to perfect. Even experienced players often have frustratingly difficult times in correcting errors in their game. One of the reasons is that there are numerous theories concerning how to hold and swing a club. No one knows for sure which is the best way. Further, because of differences in physical abilities, skill, previous habits and the like, what may be a preferred golf swing or stroke for one person may not be the preferred or even the correct swing for another.

However, what is fairly universally accepted by teaching professionals and the better players is that consistency is important. Further, proper characteristics of the club at the time of impact with the ball is also vital, regardless of how one individual may swing the club into the position of impact compared with another individual. Two of the most important characteristics or parameters for achieving a good putting result from a golf stroke are: controlled velocity and controlled face angle of the club head on impact with the ball. These two characteristics or parameters are also important in connection with the longer golf shots, both with woods and irons. Two other important characteristics for a fuller stroke are: (1) hitting the "sweet spot" of the club head with the ball and (2) hitting the ball along an intended line or travel path, rather than sweeping across the ball to invite a "hook" or a "slice" or to cause a "pull" or a "push" when in combination with a closed or open face angle, respectively. Further, it is also important not to hit the ball too high or too low and not to have the club shaft too far in front of the club head or too far behind the club head at impact. Mastering these various characteristics, while not exhaustive, are fundamental to achieving consistently desirable results from a golf swing.

Various means are available to players "to improve their games." Among the most popular are the use of a teaching professional, reading from the voluminous writings on the subject, practice driving ranges, visual recording devices (e.g., closed circuit television with a video tape recorder), and physically constraining devices (e.g., straps connected to the club to help the golfer from deviating from a "perfect" stroke). All of these means have their place. However, none of these give the golfer an instantaneous measurement of the various component characteristics of his own golf swing for self analysis purposes.

Therefore, it is a feature of the present invention to provide an improved electronic golf swing measuring apparatus to permit the user to view various individual important characteristics of his swing as set forth in discrete readings.

It is another feature of the present invention to provide an improved electronic golf swing measuring apparatus for permitting the user to view the velocity and face angle of a putter or other golf club as displayed in discrete readings, as with LCD readouts.

It is still another feature of the present invention to provide an improved electronic golf swing measuring apparatus for permitting the user to view the velocity, face angle, deviation from hitting the "sweet spot" and deviation from desired path of either a wood or an iron as displayed in discrete readings.

It is yet another feature of the present invention to provide an improved alternate electronic golf swing measuring apparatus for permitting the user to view the velocity and shaft angle or hand position of either a wood or an iron as displayed in discrete readings.

It is still another feature of the present invention to provide an improved golf swing measuring apparatus for permitting the user to recognize, along with other parameters, the tendency to top the ball or to take divots.

It is yet another feature of the present invention to provide an improved electronic golf swing measuring apparatus for permitting either or both the user and a remotely located observer, such as a teaching professional, to view various characteristics of the golf swing of the user as set forth in discrete readings.

It is still another feature of the present invention to provide an improved portable electronic golf swing practice device having support legs that can conveniently revolve to form a compact unit with the cabinet or housing and to form carrying handles therefor.

SUMMARY OF THE INVENTION

A preferred embodiment of the present invention useful in giving pertinent information to the user concerning his putting stroke includes three photoelectric sensors actuable upon movement of the club head during a practice swing. These transducers may be imbedded in a mat so that as the club passes over them, light to the sensors is interrupted, thereby producing impulses to logic circuits. Alternately, the sensors are located in a portable housing positioned over the practice area and actuated by light reflecting from a reflective surface of the club head as it passes along the travel path of a practice area. A directed artificial light in the cabinet to the area of the critical travel path just in front of the ball position ensures greatest reliability of sensor triggering.

From the timing of impulses of two sensors spaced apart longitudinally along the path, the velocity of the club head is determined. From this measured velocity and the times that the face of the club head encounters two sensors spaced on a line normal to the travel path, face angle is determined. One of these latter two sensors is preferably one of the velocity-determination sensors.

Visual displays of the two measurements are presented on discrete LCD readouts to the user.

A preferred embodiment of the present invention useful in giving pertinent information to the user concerning his wood or iron shots includes the same elements as with the putting apparatus just described and includes, in addition, two lined arrays of sensors spaced apart from each other along the travel path, each array being along a line normal to the travel path. A first array is close to where the ball position is located and the other array precedes the first array by about 3 inches. A string of sensors in the array closer to the inpact position is actuated by receiving light reflection from a bright or reflective surface on the top of the golf club head and actuates a visual display of lateral deviation from the travel path at the point of "impact" (i.e., too close to the heel or too close to the toe). Of course, the ball is preferably not at the ball position, so actual "impact" will not occur, only "impact" in a figurative sense. This lateral deviation display is an indication by discrete presentation (a sensor corresponds to a specific LCD segment) of how close the stroke was to the "sweet spot".

By using the impulses from the actuated string of sensors in the other array, another display is presented, showing where the club head was a short distance in front of its position when it created the "sweet spot" display. Hence, path direction is determined and presented in display fashion as a deviation from the intended path direction.

A variation available includes, through the use of a mirror, reflections from the surface of the shaft as imaged on the sensors responsible for creating the impulses for calculating face angle. Hence, hand position (or shaft angle) with respect to club head is displayed, instead of face angle.

The portable apparatus is contained within a housing having legs that can either act as supports or, together, as a carrying handle for the housing.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings from a part of this specification. It is to be understood, however, that the appended drawings illustrate only typical embodiments of the invention and are therefore not to be considered limiting of its scope, for the invention may admit to other equally effective embodiments.

IN THE DRAWINGS

FIG. 1 is a representation of the sensor placement in a golf swing measuring device in accordance with the present invention, primarily suitable for measuring putting characteristics.

FIG. 2A is a representation of suitable visual displays in accordance with a first preferred embodiment of the present invention.

FIG. 2B is a representation of suitable visual displays in accordance with a second preferred embodiment of the present invention.

FIG. 3 is a representation of the sensor placement in a golf swing measuring device in accordance with the present invention, primarily suitable for measuring the characteristics of full golf strokes.

Figure 4:
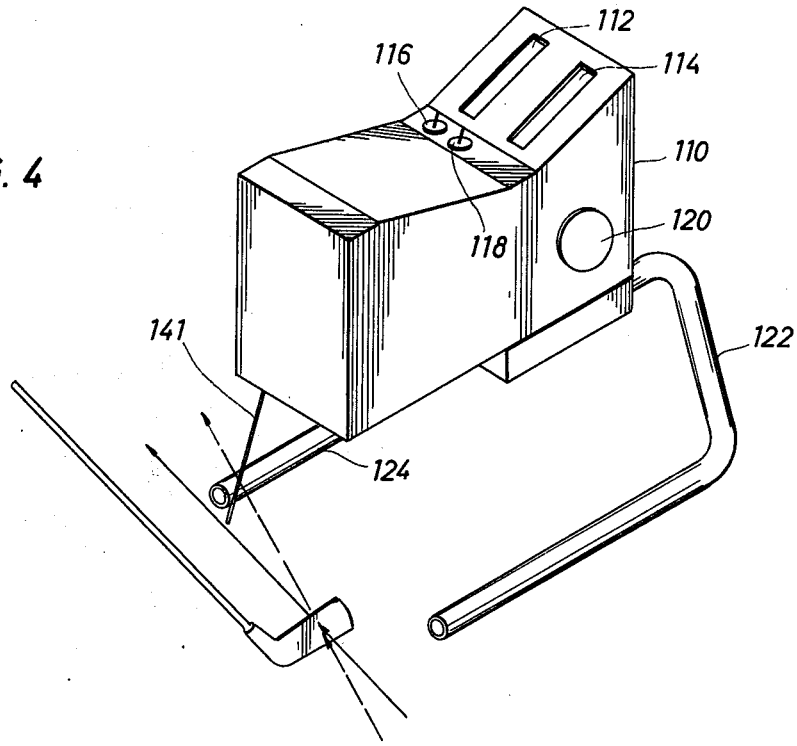

FIG. 4 is an oblique view of a suitable golf swing measuring device in accordance with the present invention.

Figure 5:
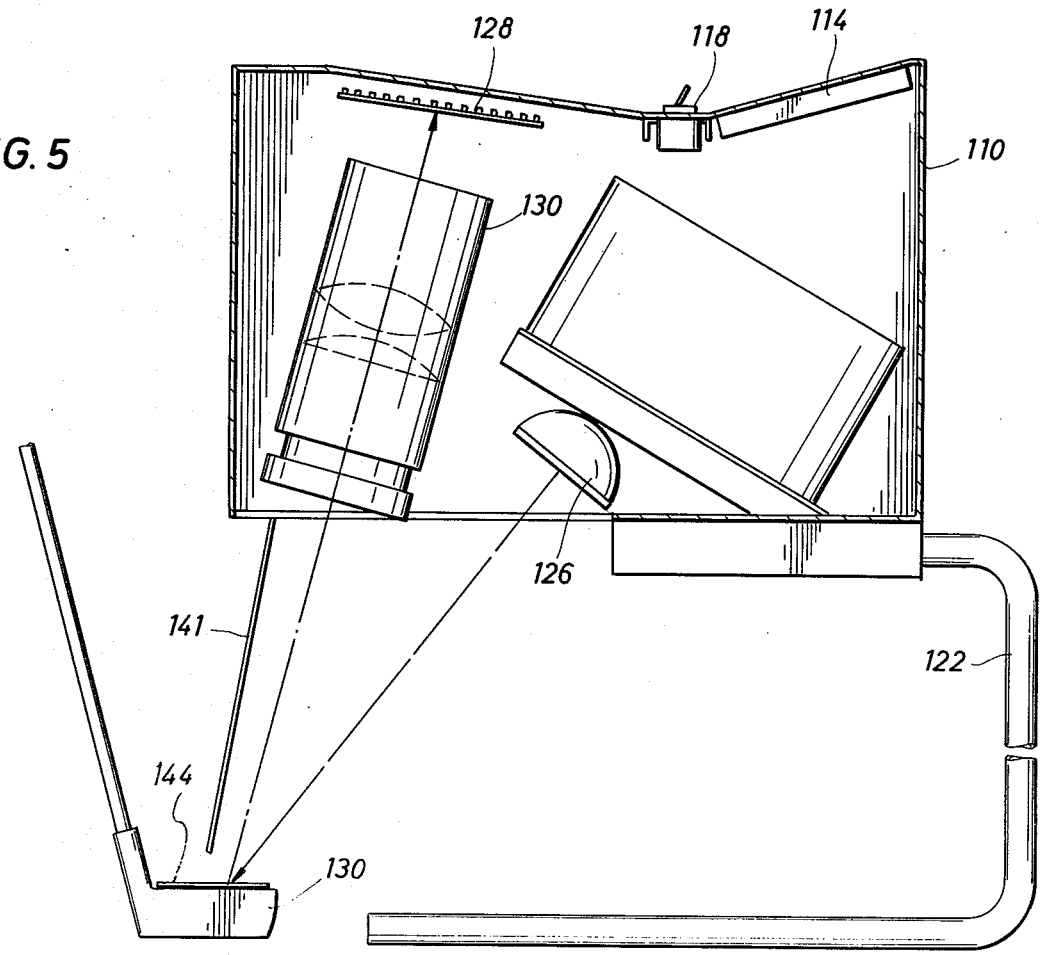

FIG. 5 is a cutaway view of the apparatus illustrated in FIG. 4.

Figure 6:
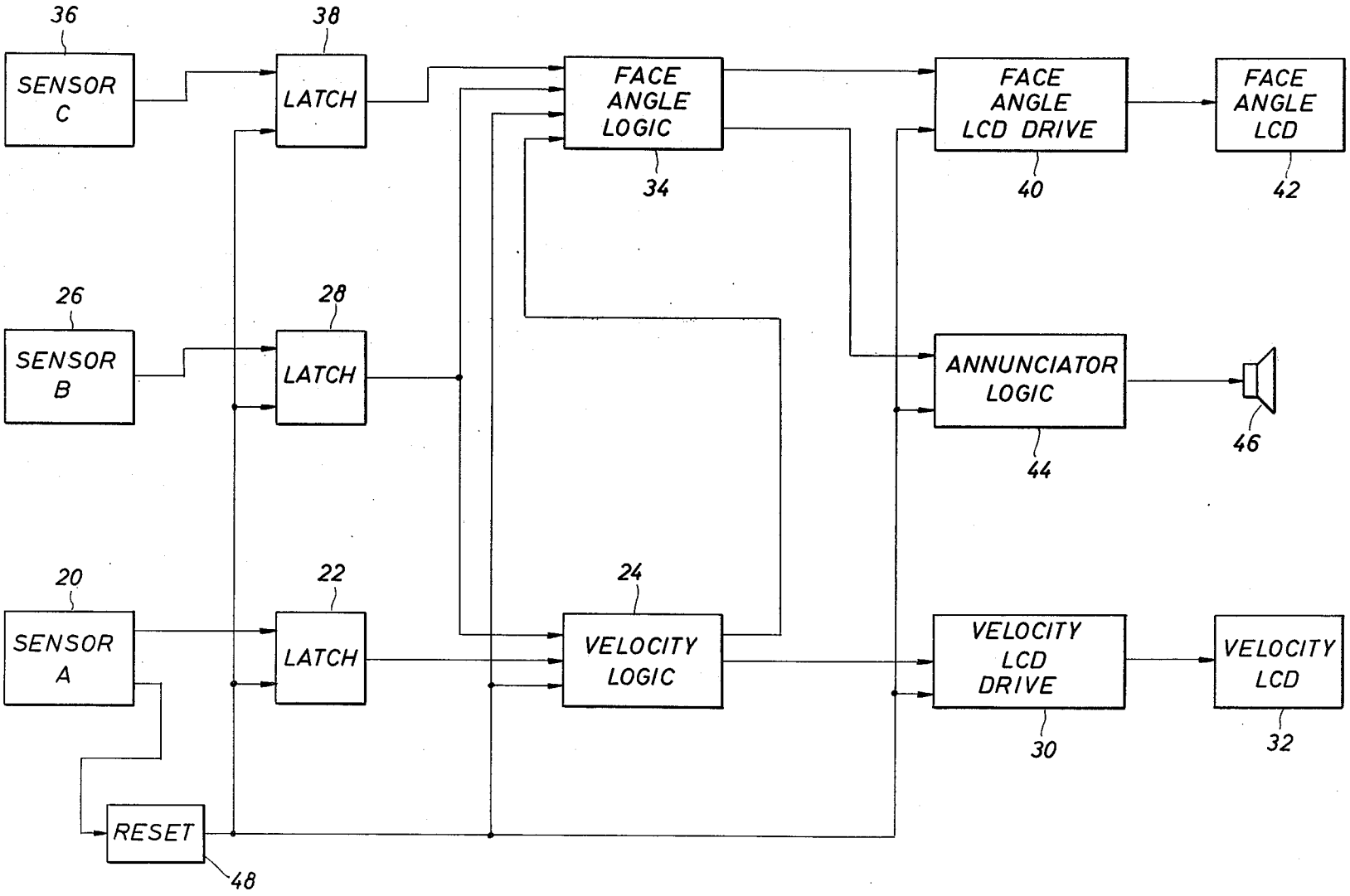

FIG. 6 is a block diagram of a golf swing measuring apparatus in accordance with the present invention, primarily useful for measuring putter characteristics.

Figure 7:
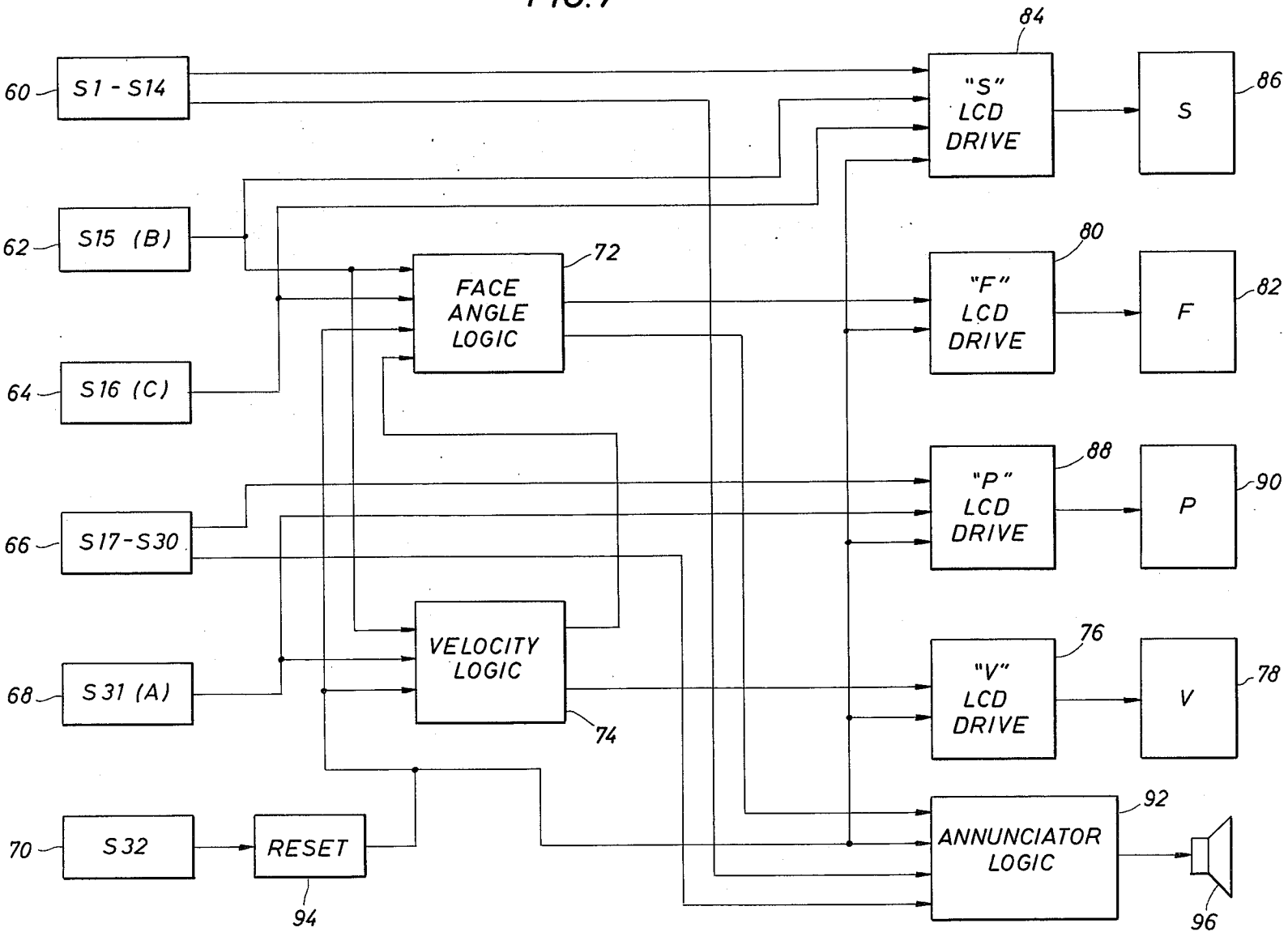

FIG. 7 is a block diagram of a golf swing measuring apparatus in accordance with the present invention, primarily useful in measuring characteristics of a full golf swing.

Figure 8:
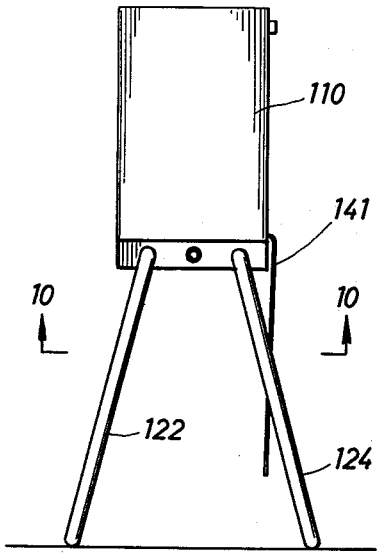

FIG. 8 is an illustration of a golf practice apparatus in accordance with the present invention having support legs extended for support.

Figure 9:
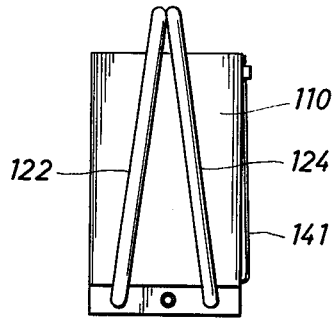

FIG. 9 is an illustration of a golf practice apparatus in accordance with the present invention having support legs folded to become a convenient handle for carrying purposes.

Figure 10:
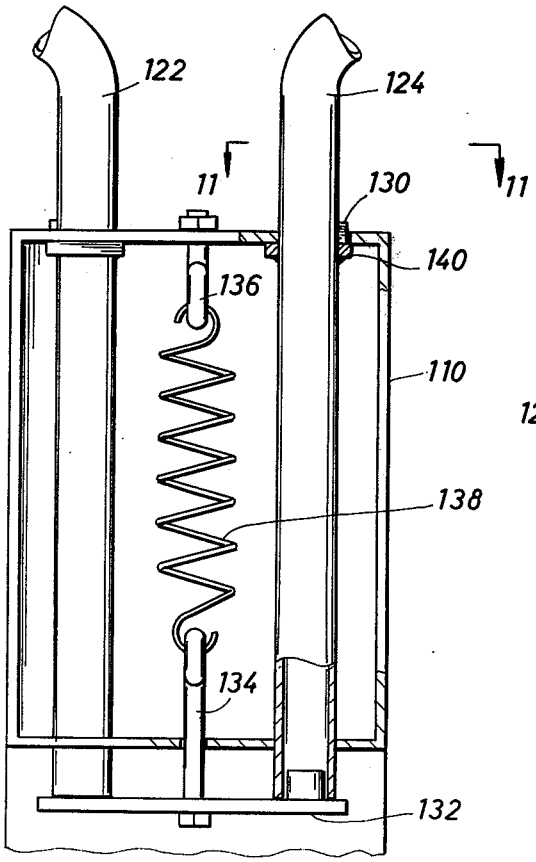

FIG. 10 is a section view taken at line 10—10 of FIG. 8.

Figure 11:
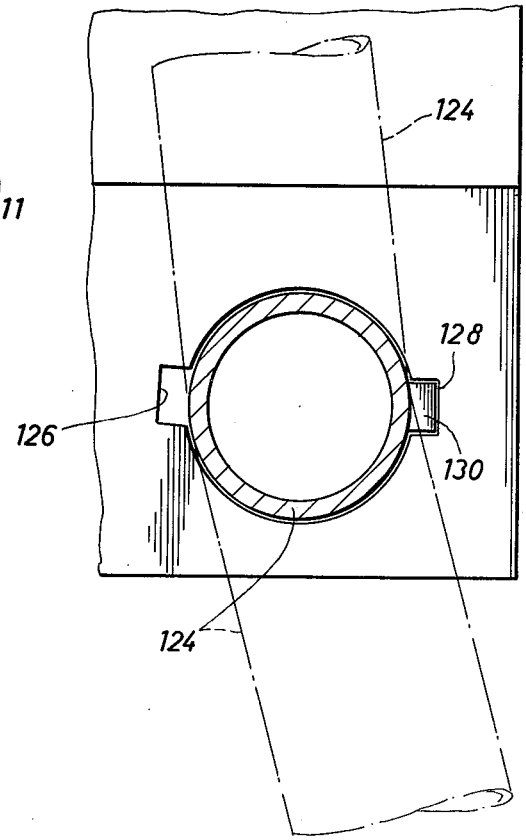

FIG. 11 is a view taken at line 11—11 of FIG. 10.

DESCRIPTION OF PREFERRED EMBODIMENTS

Now referring to the drawings and first to FIG. 1, a representation is shown of photoelectric sensor locations of an embodiment of the present invention particularly suitable for measuring the important parameters relating to a putting stroke. The sensors may be embedded in a mat over which the golf club head is stroked, sensor actuation being determined by the interruption of light to the sensors as the club head passes by. Alternately, the sensors are located in a cabinet supported over the practice area, the sensors working in conjunction with light reflection from the club head. That is, as the club passes a sensor location, light is reflected off the top of the club head to the sensor in the cabinet, thereby triggering an impulse therefrom.

The intended club head path for the putter during a practice swing is along club path 10, from right to left. Sensor A is located with respect to the swing to precede ball position 12 at a distance of about one inch and Sensor B is located logitudinally along club path 10 with respect to Sensor A in the near vicinity of ball position 12, but just in front of it. The actual use of a practice ball at ball position 12 is optional. Finally, Sensor C is located spaced apart from Sensor B so as to form a line at an angle with club path 10, preferably to form a line which is normal or perpendicular with club path 10.

As mentioned, Sensors A, B and C are preferably photoelectric sensors which may be actuable in one of two ways. First, ambient light or a captive light may be directed at the sensors from above, the sensors being imbedded in a mat, such that interruption by the passage of a golf club head along club path 10 would interrupt the light to the sensors and therefore create impulses to logic means hereinafter described. Alternatively, the sensors may be located at the focal plane of an imaging system in a cabinet or housing located above the club path travel area so as to receive focused light reflections off a reflective surface on the top of the golf club head. That is, each sensor is at the focal plane of the optical or camera system for a very small area of the club head. Typically, each sensor is focused on an area about $\frac{1}{8}$ inches wide. It may be further recognized that either ambient light or a specially directed artificial light may be used to establish a beam for reflective purposes. Further, the top of the golf club head acting as the reflective surface may be made more reflective by use of stick-on white tape or paint and dark tape or paint may be used to dull highly reflective surfaces that may cause false or interfering reflections. Light shields may be employed also to prevent bright ambient light from either causing false triggering or from preventing triggering. Further, the mat or floor surface should be dark so as to create a substantial contrast with the reflective surface.

Logic means, to be more fully explained hereinafter, is included in the cabinet of the apparatus and connected to the sensors for calculating from the impulses received from Sensors A and B the velocity of the golf club head as it moves along club path 10. Additional logic means, also to be more fully described hereinafter, is connected to Sensors B and C for calculating from the time of the respective impulses therefrom and from the velocity measurement, the face angle of the golf club head as it passes across Sensors B and C.

As illustrated in FIG. 2A, the results of the face angle measurements and the velocity measurements are displayed using 32 segments of an eight-digit liquid crystal display (LCD) readout. The velocity increments are set forth in the illustration in miles per hour, however, feet per second, kilometers per hour or other velocity units of measurement may be used. However, notice that the readout is in discrete steps regardless of the units of measurement. The face angle deviation is in terms of a measurement from zero face angle (normal to path) in terms of degrees. For putter characteristics' measurements, FACE ANGLE is shown is ½-degree increments to ±3½ degrees and VELOCITY is shown to 15 miles per hour. In addition, an approximate length of putt in feet may be shown.

In the illustrated measurements, the indication is that the velocity was 2½ mph and the face angle of the club during the measured swing was two degrees, face closed. The OPEN and CLOSED above and below the FACE ANGLE display stand for "face opened" and "face closed," respectively.

If the face angle is within acceptable limits, for example two degrees, an audio signal also may be produced.

Resetting of the display and of the electronics in the apparatus occurs whenever Sensor A is actuated by club head motion. If triggering is on the backswing, or during a preswing "waggle", a transient, meaningless, and harmless calculation and display results. Triggering on the forward swing results in latching in a correct display, latched until the next reset trigger.

Now referring to FIG. 6, a block diagram of a circuit for functionally operating as described above, and which may be implemented by conventional components, is illustrated. Sensor electronics A, also idenfified with numeral 20, produces a impulse when the club head passes thereover. A typical electronic unit capable of producing such an impulse includes, in addition to the sensor element, a comparator which produces an output when the input from the sensor element and from applied comparison signal are sufficiently different from each other. For purposes herein, "sensor" is used to include the sensor element and the necessary electronic components that produce an impulse when the sensor is actuated.

The output from Sensor A 20 is applied to latch 22, which may include a standard flip-flop circuit, for producing an output to velocity logic circuit 24.

In similar fashion, Sensor B 26 produces an output to latch 28, which, in turn, produces an output to velocity logic circuit 24. The output from velocity logic circuit 24 is applied to velocity LCD drive 30. Velocity logic circuit 24 may include suitable counters for producing the appropriate output to drive 30 in accordance with the time difference between the signals received from latches 22 and 28. If the two signals are close together, then the velocity of the club head is high. If, on the other hand, the signals are relatively far apart, then the velocity is relatively low. Therefore, pulses spaced apart so that the second pulse is within a given "window" range with respect to the location of the first pulse, produces a corresponding drive signal for illuminating an increment on the display readout and all other increments marked with a lesser velocity number. In the illustration of FIG. 2A, it may be seen that a 2½ mile per hour reading is shown. The output from velocity LCD drive 30 to velocity LCD indicator 32 would be such as to illuminate the four segments of the display up to and including the 2½ mph reading.

The output of latch 28 is also applied to face angle logic 34.

In a fashion similar to what has been described above, Sensor C 36 produces an output to latch 38 which, in turn, produces an input to face angle logic circuit 34. An output from velocity logic circuit 24 is also applied to face angle logic circuit 34.

It may be readily understood that if the signal from Sensor B is applied before the signal from Sensor C, logic components from within face angle logic 34 would insure an open face indication. The opposite would be true when the Sensor C signal is received before the Sensor B signal.

Further, face angle logic circuit 34 also produces a signal in accordance with the time delay between the signals received from Sensor B and Sensor C which, in turn, is applied to comparison components with the velocity signal from velocity logic circuit 24, to produce a discrete face angle signal.

The mathematical expression for FACE ANGLE is as follows:

$$\text{FACE ANGLE} = \frac{t_{B-C}}{t_{A-B}} \times \frac{d_{A-B}}{d_{B-C}} \times \frac{360}{2\pi},$$

where t is equal to time lapsing between the passage of the indicated sensors and d is equal to the distance between the indicated sensors. Note that all elements of the formula except time reduces to a constant and therefore the measurement is merely a built-in constant times the time difference in the occurrence between the signals from latch units 28 and 38 divided by the output from velocity logic circuit 24.

The signal from logic circuit 34 is applied to face angle LCD drive circuit 40 which, in turn, produces an output to face angle LCD 42. The circuit actuates all of the lesser included increments, as well as the actual increment, for better clarity of display. As will be seen in FIG. 2A, the display of face angle for the illustrated swing is two degrees, face closed.

An output from face angle logic 34 is also applied to annunciator logic 44 when the face angle signal indicates that the face angle is within an acceptable range, for example two degrees or less. Annunciator logic 44 produces a signal to audible transmitter or speaker 46.

It may be seen that the above-described golf swing measuring apparatus provides an indigenous, discrete readout to the user of his ability to maintain control over the face of his club as well as the speed of his club. The audio signal is provided to encourage him to swing well and to provide instant feedback.

When Sensor A is actuated a second time (after the circuits have once been operated as above described), the entire electronics, including displays, in the apparatus receive reset signals from reset circuit 48.

Now turning to FIG. 3, a plan view of the sensor arrangement in a golf swing practice apparatus is shown for measuring the various characteristics or parameters most important with respect to a full golf stroke, either made with a wood or an iron.

Again, the desired path 50 is from right to left. Sensors S15 and S16 are positioned in the near vicinity of the ball position, preferably just preceding the ball position with respect to the swing, and correspond respectively with Sensors B and C shown in FIG. 1. Preceding Sensor S15 along the intended travel path of the golf club head is Sensor S31, corresponding for velocity calculations to Sensor A of FIG. 1.

A first array of sensors forming a line with Sensor S15 and S16 include Sensor S1 through S14. Preferably this line is normal to or perpendicular to path 50. The individual sensors S3 through S13 are spaced at a uniform distance from each other. Sensor S2 is spaced twice that distance from both Sensors S3 and S1.

A second array of sensors including Sensors S17 through S30 form a line parallel to the line formed by the first array and includes Sensor S31. There is a corresponding sensor in the second array for each sensor in the first array.

As may be seen from the diagram, the distance measured at the ground between arrays is approximately three inches. The imaged ball position is slightly forward of the first array.

Sensor S32 preceding the second array is used for reset in a manner to be hereafter explained.

It may be seen that path 50 not only indicates the proper direction for the travel path for the club head for a perfect swing, but also passes just above center Sensors S8 and S24 of the first and second arrays. This indicates the ideal path for the end of the reflective surface on the club head (e.g., a strip of white tape on top of the club head parallel with the club face, the path end thereof being at or near the toe) to pass through in order for the club head to pass through the ball position at the "sweet spot" on the club head. Although many club heads do not need reflective enhancement, highly reflective paint or other means may be used to enhance the reflectivity of the top surface of a dark club head. It has been convenient to use a ½-inch wide, approximately 3-inch long strip of stick-on white tape running along the leading edge of the top of the club head and starting at or near the toe for this purpose. The path of the tape end may be referred to as the "reference line".

To use the apparatus to measure a practice swing, the user merely swings the club head along the travel path as perfectly as he can to simulate his conventional golf stroke. The measurement of velocity and face angle is the same as with the putting stroke measuring version of the invention described above. For such a fuller golf-stroke characteristics, measurements, FACE ANGLE is shown in 2-degree increments in FIG. 2B to ±20 degrees and VELOCITY is shown to 130 miles per hour. In the illustrated measurements, the indication is that the velocity was 80 mph and the face angles of the club during the measured swing was four degrees, face closed.

To understand the additional measurements that can be made, reference should be made to the display of these measurements illustrated in FIG. 2B. FIG. 2B includes measurements for SWEET SPOT and PATH. The SWEET SPOT read out includes HEEL and TOE deviations from the SWEET SPOT at the top and bottom of the display, respectively.

When a club head travels across the first array so that the reference line passes just above sensor S8, sensors S8 through S16 are actuated and there is no deviation from the "sweet spot". Hence, the SWEET SPOT display shows "zero". However, if there is a lateral division deviation from the "sweet spot" such that more or fewer sensors are actuated, then there is an indication of deviation on the display readout. In the example, the "sweet spot" was missed 0.2 inches toward the heel. Notice that all of the discrete increments in the readout corresponding with those sensors that are actuated, are illuminated.

When the reference line of the club head passes through corresponding sensors in the first and second array, then it is traveling along the line parallel with path 50. If there is deviation from that line such that the actuated sensors do not correspond in the respective arrays, there will be a path deviation measurement. In this case, there is a "3" indication on the path readout and a "2" indication on the "sweet spot" readout, making a deviation of 0.1 inch overall path deviation, outside-in. (Alternatively, since 0.1 inches on a 3-inch base represents about 2 degrees, the difference between SWEET SPOT and PATH may be translated into a path deviation in increments of 2 degrees.)

Now referring to the block diagram shown in FIG. 7, sensor input development circuits are marked in the diagram as follows: Sensors S1–S14 by 60; Sensor S15 by 62; Sensor S16 by 64; Sensor S17–S30 by 66; Sensor S31 by 68 and Sensor S32 by 70. As indicated in the above description, excepting reset, Sensors S31, S15 and S16 correspond respectively to Sensors A, B and C for the block diagram shown in FIG. 6. Further, insofar as initiating signals for achieving the same kind of display as that shown in FIG. 6, the output of sensor 62 is applied to face angle logic circuit 72 and velocity logic circuit 74. The output of sensor 64 is applied to face angle logic circuit 72. The output of sensor 68 is applied to velocity logic circuit 74.

The output from velocity logic circuit 74 is applied to VELOCITY LCD drive circuit 76, which, in turn, is applied to LCD display VELOCITY 78.

The output of velocity logic circuit 74 is applied to face angle logic circuit 72 and the output from logic circuit 72 is applied to FACE ANGLE LCD drive 80, which, in turn, is applied to LCD display FACE ANGLE 82.

The output from Sensors S1–S14 (block 60) is applied to SWEET SPOT LCD drive circuit 84 together with the output from sensors 62 and 64, which are also parts of the array. LCD display SWEET SPOT 86 receives the output from drive 84. Specifically, the displays which corresponds to the sensors producing the impulses receive the signals for displaying in accordance with the illustration of FIG. 2B. If all of the sensors produce impulses, then all of the increments on the display are lit, there being a display increment for each sensor. As may be further seen, the distance between sensors is indicated by the readout markings.

Segment "17" on display SWEET SPOT represents sensor S16 and, taken with adjoining display segment 9, reassures the user that sensors S16 and S15 are operative for FACE ANGLE and VELOCITY calculations. Segments marked "HI" and "LO" are used with appropriate driving logic merely to warn of light level thresholds.

The output from Sensors S17–S30 (66) are applied to PATH LCD drive circuit 88, together with the output from Sensor S31 (68), since it is part of the array with Sensors S17–S30. The output from drive 88 is applied to LCD display PATH 90. Again, the corresponding displays are illuminated in accordance with the corresponding sensor impulses.

Annunciator logic circuit 92 receives the inputs from face angle logic 72, Sensor S4–S12 in block 60 and Sensors S18–S24 in block 66. When the "sweet spot" is within 0.4 inches, the path is within 0.3 inches (six degrees) from the intended path and the face angle is within four degrees, then an audio signal will be produced from audio transmitter 96.

As illustrated in FIG. 7, individual Sensor S32 (70) applies its output to reset circuit 94 which, in turn, resets all the logic circuits and displays in the diagram. Again, reset may occur on a "waggle" of the club head or during the measured stroke. In either event, Sensor S32 is actuated before the actuation of the sensors used in the measurements.

Now referring to FIG. 4, a physical representation of a machine in accordance with the present invention is illustrated. The cabinet for the electrical apparatus is identified by numeral 110. Appropriate displays 112 and 114 are presented for viewing by the user of the apparatus. Electrical power is supplied to the electronics and to the internal light by switches 116 and 118, respectively. A built in speaker 120 makes the audible sound when the golf swing characteristics are within acceptable ranges, as explained above.

As best seen in FIG. 5, the golf club head passes along a travel path underneath a portion of the cabinet as supported thereover by U-shaped legs 122 and 124. Tubular construction for legs 22 and 24 has been found convenient.

Located within the cabinet above the club head in a position to receive reflections from either natural or artificial light 126, is sensor array 128, which may be representative of the arrays previously discussed.

A camera or optical system 130 is included in cabinet 110 for focusing the light directed at sensors 128 from the light reflective surface of the club head.

To further enhance the change in light reflection to the arrays, a white or black tape or paint strip 144 may be applied to the reflective surface of club head 130.

This machine may also be used to measure the golf club shaft angle (hand position with respect to the club head). When such a measurement is desired, a mirror 146 may be placed in the light path as shown. In this manner reflections from the club shaft 152 will proceed along light path 148 and be reflected by the mirror 146 through the camera or optical system 130 and thus to sensors 128. As discussed above with respect to the club head, a strip of white or black tape or paint strip 144 150 may be applied to the shaft 152 to enhance the change in light reflection to the sensor array 128.

FIGS. 8 and 9 show legs 122 and 124 in each of the two latching positions. In FIG. 8, legs 122 and 124 are shown supporting cabinet 110 in a position of use. FIG. 9 illustrates legs 122 and 124 rotated so as to jointly form a handle for cabinet 110 and therefore make it conveniently portable.

It may be seen in FIG. 10 that leg 124 is partially internal to cabinet 110 through an opening having keyhole recesses 126 and 128. A projection 130 affixed to leg 124 is aligned with respect to keyhole recess 128 when leg 124 is in its support position. Projection 130 is aligned with keyhole recess 126 when leg 124 is rotated to its carrying position.

So that projection 130 does not inadvertently come loose from its keyhole recess, plate 132 in constrained juxtaposition with leg 124 has a hook 134 for resilient connection to hook 136 attached to cabinet 110. A tension spring 138 is connected between hook 134 and 136 for this purpose. Stop projection 140 is attached to leg 124 internal to cabinet 110 so that when leg 124 is urged outwardly of the cabinet, stop 140 presses against the inside wall of the cabinet to insure the position of projection 130 within the limits of a keyhole recess.

In similar fashion leg 122 is secured through an opening in the wall of cabinet 110 to plate 132.

So as to permit rotation of legs 122 and 124, the tubular ends of these legs are merely fitted over mating nubs on plate 132. When it is desired to rotate legs 122 and 124 to their opposite positions, the legs are pushed back into the cabinet away from the stop positions illustrated to overcome the tension of spring 138 and to permit rotation of the legs until their respective projections are opposite the other (carrying position) recesses. At this time the legs are permitted to extend until the stops are again against the inside wall of cabinet 110 and projection 130 and its complement are held within their keyhole recesses.

Pointer 141 is hinged to cabinet 110 and aimed at the ball position to facilitate alignment of the user's swing. The pointer, particularly useful in the absence of a ball, extends to about 3 inches above the ground or mat so that a swing too far off the ground ("topping the ball") will cause striking of the flexible pointer, causing it to hinge out of the way and giving the user instant visual and audible feedback of his error. Too low a swing is, of course, signalled by the club striking the ground or mat.

While particular embodiments of the invention have been shown, it will be understood that the invention is not limited thereto. For example, it is possible to cable connect all of the logic circuits to a remote display to make the remote display available to a teaching professional.

Sun shields may be provided to prevent ambient light from interfering with the appropriate operation of the sensors. Since the sensors in the apparatus are light sensitive, it is important that the operation is with respect to a uniform ambient light. A shadow across the area of the travel path or, conversely, a stray bright beam, may well cause false actuation of the sensors. Therefore, it has been found convenient to use a light shield or shields around the apparatus to ensure against false signals. Usually all that is required is a shade screen or shield on a flexible rod that may be stuck in the ground and moved to ensure a uniform shaded (or bright) travel path area.

A mat accessory may be included having a diagram thereon of the travel path to provide an initial mechanical or non-judgmental means for insuring that the club head starts in a square (normal face) position. This may include a white line 11 drawn normal to path 10. Such means is particularly valuable for the putting stroke where the user can develop his ability to initially align his club, in addition to improving his ability to swing the club properly. This accessory provides practice to the user to control his putter at every aspect of a stroke, including aiming the putter precisely and non-judgmentally before each swing, thus developing his muscle skills independently of his aiming capability. Also, the device described above for measuring the parameters of a putting stroke is made cheaper with the sensors embedded in a mat since this avoids the camera or optical system and sensors are not subject to damage with normal putting technique.

It should be further noted that the invention has been described with respect to a right-handed golfer. Clearly, the devices may be readily modified for left-hand application.

Description of the displays has been with respect to multi-digit LCD's. Clearly, custom designed "bar graph" type LCD's may be employed. All such displays may be referred to as "multi-segment" displays.

Many other modifications may be made and will become apparent to those skilled in the art.

What is claimed is:

1. A golf swing measuring apparatus, comprising:

a first sensor for providing a first signal when a first portion of a golf club head reaches a first location;

a second sensor for providing a second signal when said first portion of the club head reaches a second location spaced later in the swing from the first location by a longitudinal distance;

a third sensor for providing a third signal when a second portion of said club head reaches a third location spaced transversely by a lateral distance from said second location with respect to the club swing;

velocity calculating means for computing the velocity of the club head in response to inputs representing said longitudinal distance and the difference in time between the occurrence of said first signal and the occurrence of said second signal; and face angle calculating means for computing the face angle of the club head in response to inputs representing said computed velocity, said lateral distance, and the difference in time between the occurrence of said second signal and the occurrence of said third signal.

2. The apparatus of claim 1, wherein said sensors are positioned below the trajectory of said golf club head during said swing and receive light from above the trajectory, the passage of the club head thereby interrupting the light path to said sensors and thereby effecting said signals.

3. The apparatus of claim 1, further comprising a visual display for indicating said computed velocity and said computed face angle.

4. The apparatus of claim 3 wherein said visual display comprises a multi-segmented, liquid crystal readout.

5. The apparatus of claim 1, further comprising an audible transmitter adapted to produce a sound when the computed face angle for the swing is within a predetermined acceptable range.

6. The apparatus of claim 1, further comprising a reset mechanism, said reset mechanism adapted to reset said velocity calculating means and said face angle calculating means upon actuation by said club head.

7. The apparatus of claim 1, further comprising a mechanical pointer, said pointer adapted to contact said club head when the club head is held too high in said swing.

8. The apparatus of claim 1, wherein said sensors are positioned above the trajectory of said golf club head during said swing and are aligned to receive focused reflections of light from the club head, the passage of the club head along the trajectory thereby causing a change in the light received by said sensors and thereby effecting said signals.

9. The apparatus of claim 8, further comprising an optical system for focusing the imaged reflections of said club head on said sensors.

10. The apparatus of claim 8, further comprising:

a first array of sensors, which may include said first sensor, positioned along a line perpendicular to the path of said club head in said swing for providing a first array signal;

a second array of sensors, which may include said second and third sensors, positioned along a line parallel to said first array for providing a second array signal;

a lateral position calculator for generating from said second array signal a lateral deviation signal representing the lateral deviation of said club head during said swing from an ideal club path; and an angular path deviation calculator for generating from said lateral deviation signal and from said first array signal an angular deviation signal representing the angular path deviation of said club head from an ideal club path during said swing.

* * * * *